United States Patent [19]

Dukes

[11] 3,964,352

[45] June 22, 1976

[54] BACK-UP WRENCH FOR THREADED CONNECTORS

[75] Inventor: Bobby Wayne Dukes, Houston, Tex.

[73] Assignee: N-S-W Corporation, Houston, Tex.

[22] Filed: Feb. 7, 1975

[21] Appl. No.: 547,842

Related U.S. Application Data

[63] Continuation-in-part of Ser. No. 456,569, April 1, 1974, abandoned.

[52] U.S. Cl. ..... 81/426

[51] Int. Cl.[2] ..... B25B 7/02

[58] Field of Search ..... 81/418–426

[56] References Cited

UNITED STATES PATENTS

| | | | |
|---|---|---|---|
| 743,593 | 11/1903 | Thumann | 81/424 X |
| 1,427,550 | 8/1922 | Ridings | 81/424 X |
| 2,385,654 | 9/1945 | Seashore | 81/424 |
| 2,478,696 | 8/1949 | Isele | 81/424 X |
| 3,585,704 | 6/1971 | Schroeder | 81/418 X |

*Primary Examiner*—James L. Jones, Jr.
*Attorney, Agent, or Firm*—Michael P. Breston

[57] ABSTRACT

The back-up wrench comprises a stationary jaw having an angular gripping wall adapted to grip two adjacent sides of different size connectors, and a rotatable jaw having a concave wall adapted to grip limited portions of two symmetrically-opposite sides of the connectors. The rotatable jaw is pivotally mounted on a cylindrical bearing surface provided by a forward extension of a plate whose rearward end is pivotally mounted on a stationary handle forming integral part with the stationary jaw. A rotatable handle is pivotally coupled to the plate. Conventional means are provided in and between the handles for applying and releasing the gripping action of the jaws against the four sides of the connector.

3 Claims, 6 Drawing Figures

BACK-UP WRENCH FOR THREADED CONNECTORS

REFERENCE TO RELATED APPLICATION

This application is a continuation-in-part of my copending application Ser. No. 456,569, filed 4-1-74 and now abandoned.

BACKGROUND OF THE INVENTION

1. Field of the Invention

This invention relates to wrenches for bolts and nuts and more particularly to back-up wrenches used for threaded connectors on flanged connections.

2. Description of Related Prior Art

The use of flanged connections on pipes, drilling tools, etc., is widespread. When two flanges are secured to each other, for example, with through stud bolts, it is necessary to use a nut on each threaded end portion of the stud. Normally, a first nut is first screwed into position on the stud and the stud is then placed through a flange hole. A second nut is then placed onto the opposite threaded end and turned to bear on the face of the flange in order to tighten the flanged connection and form a seal. Often, when turning the second nut, because of existing frictional forces, the stud with the first nut will start rotating, thereby preventing the completion of the nut-tightening operation. Such an operation may often require two operators, but when another operator is unavailable, or when space precludes the use of two operators, special nut and bolt holding devices, known as "back-up" wrenches, are used. To prevent the bolt from rotating, the back-up wrench is placed on the first nut and allowed to bear against and be supported by the next adjacent nut.

Recently, power operated wrenches have been introduced on the market for tightening flanged bolts and nuts. These power tools generate very high torques compared to manual wrenches. Such torques often force a back-up wrench very hard against the adjacent nut which supports and provides the required reaction force to the back-up wrench. After the completion of such a nut or bolt tightening operation, the removal of a conventional back-up wrench is made possible with the aid of a heavy hammer striking a hard blow to the wrench or with the aid of a long pry bar prying the back-up wrench loose from its forced seating against said adjacent nut. In contradistinction, the back-up wrench of this invention can be easily removed, even when placed under great load, by simply pulling on a release lever.

SUMMARY OF THE INVENTION

This invention provides a back-up wrench which can be easily installed on and removed from a threaded connector.

The preferred back-up wrench of the present invention is adapted for hexagonal bolts. It comprises a stationary handle having at one end thereof a stationary jaw formed by a pair of gripping planar walls forming an angle therebetween of approximately 120°. The stationary jaw is designed to grip two adjacent sides of a hexagonal nut or bolt head. A rotatable jaw is pivotally mounted on a cylindrical bearing surface provided by the forward end of a plate which is pivotally mounted on the stationary handle. A movable handle is pivotally secured to a rearward extension of the plate. The rotatable jaw has two gripping wall portions adapted to grip two opposite sides of the threaded connector. Each gripping wall portion preferably makes a line contact with the connector side being gripped. Conventional means are provided in and between the handles for applying and releasing the gripping action by the jaws.

Figure 3:
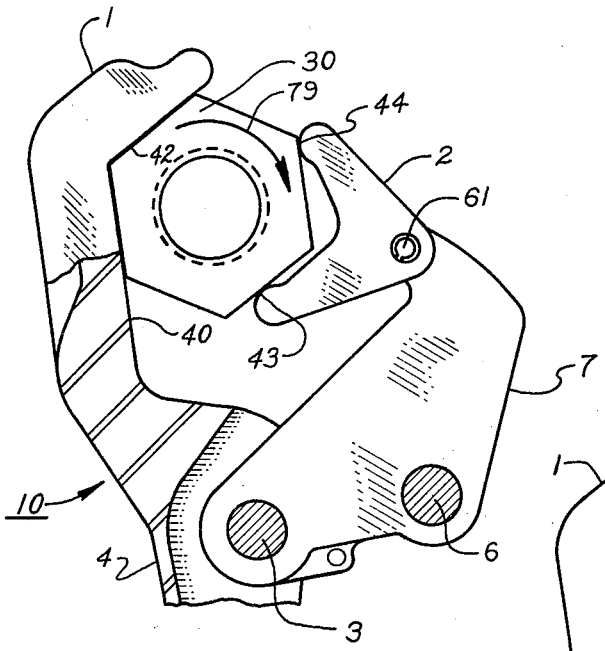
FIGS. 3–5 illustrate several holding actions of the wrench on different size nuts or bolt heads.
Figure 4:
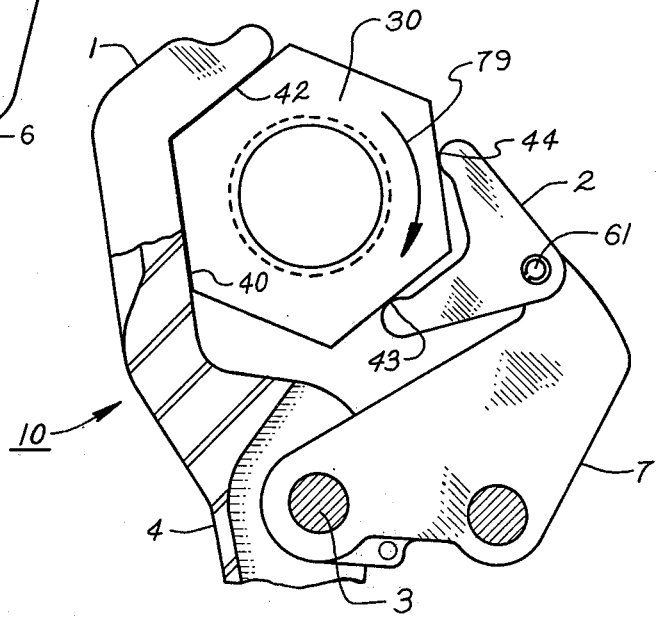
Figure 5:
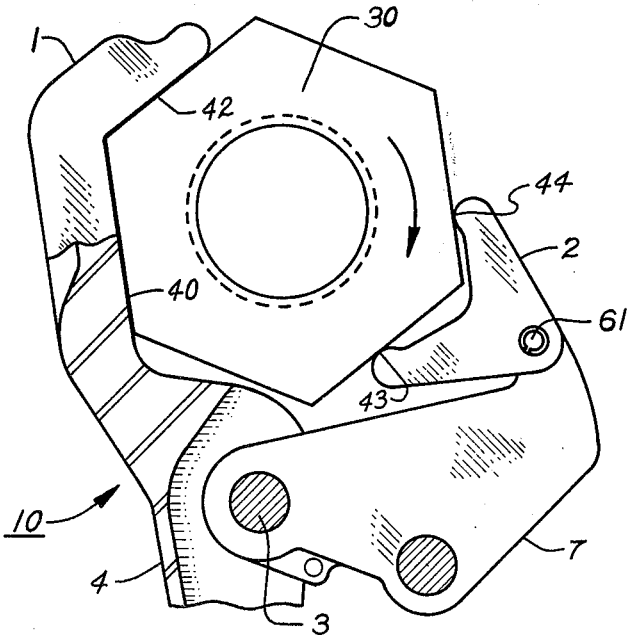

The back-up wrench 10 of the present invention comprises a stationary jaw 1 and a rotatable jaw 2. Stationary jaw 1 is designed to grip two sides of a hexagonal nut or bolt head 30 (FIGS. 3–5). Accordingly, stationary jaw 1 has two planar walls 40, 42 forming an angle *a* therebetween of approximately 120° for a nut or bolt head having a hexagonal configuration. Wall 40 has a length greater than the length of the largest size nut for which wrench 10 is designed.

Rotatable jaw 2 has a concave wall 45 defining two gripping wall portions or lobes 43, 44 adapted to preferably make line contacts with two adjacent sides of nut 30. Jaw 2 pushes the opposite corner of nut 30 into angle *a* and pushes walls 41, 42 of jaw 1 against two opposite sides of the nut. The rotation of jaw 2 ensures that the gripping wall portions 43, 44 will always make line contacts with two adjacent sides of a nut 30 within a range of nut sizes for which tool 10 is designed.

Figure 1:
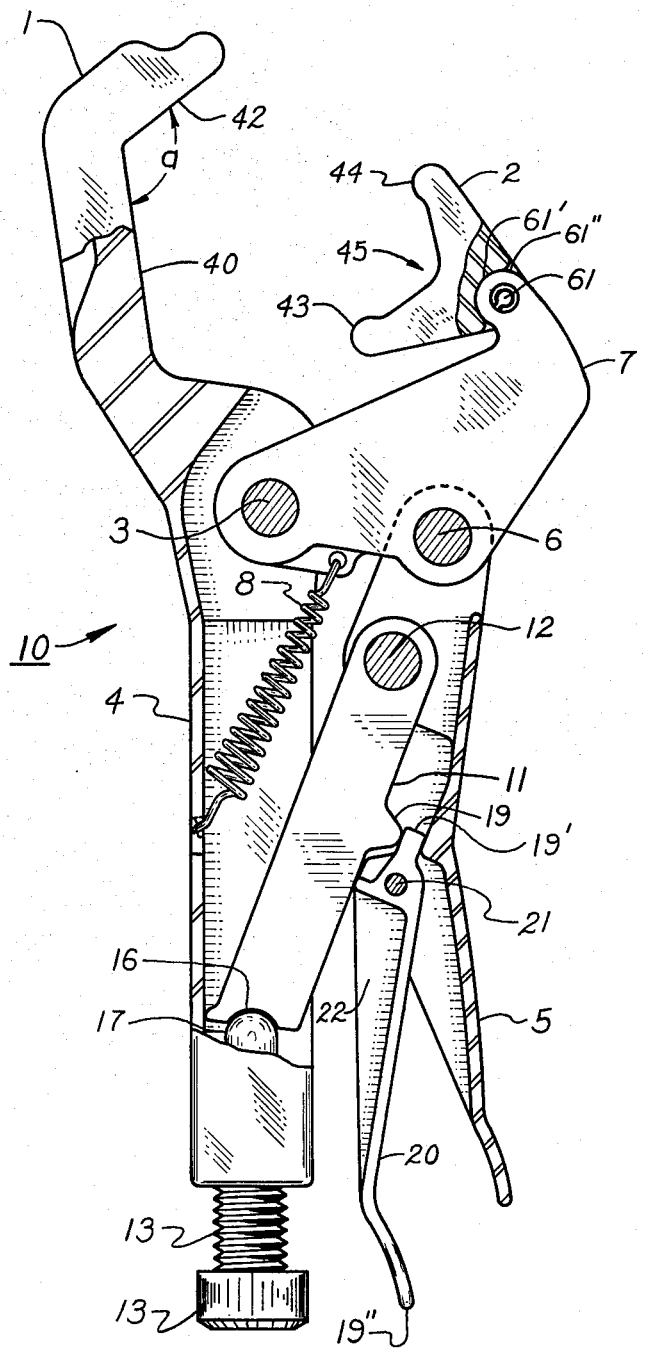
FIG. 1 is a front view, partly in section, of the back-up wrench of this invention.
Figure 2:
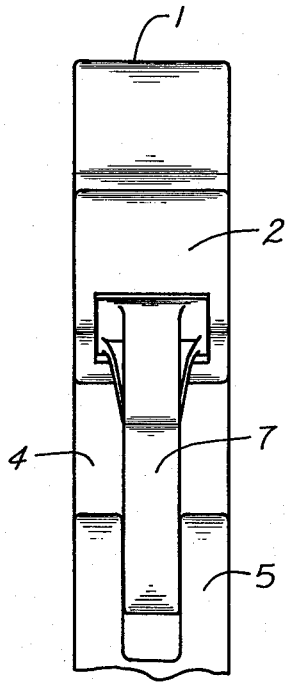
FIG. 2 is a partial side view of the rotatable jaw of the wrench shown in FIG. 1.

Jaw 2 has a concave cylindrical bearing surface 61′ which is pivotally mounted on a transverse convex, cylindrical bearing surface 61″ (FIG. 1) defined by a forward extension of a plate 7. Jaw 2 is retained on surface 61″ by a transverse retaining pin 61. Bearing surfaces 61′, 61″ allow relatively large loads, normally encountered in use, to become transmitted from jaw 2 to plate 7 without any load becoming applied to pin 61 which serves as a retainer pin only.

A stationary handle 4 extends rigidly from stationary jaw 1. The rear end of plate 7 is transversely pivoted on a pivot 3 extending through handle 4 to allow acceptance of different size nuts and to provide necessary gripping action between jaws 1 and 2. A movable handle 5 is transversely pivoted at its forward end on a transverse pivot 6 extending through a rearward extension of plate 7.

The hereinafter described means in and between handles 4 and 5 for biasing, adjusting and rotating plate 7 are generally known. Each of handles 4 and 5 has a channel cross-section. A tension spring 8 tends to pull jaws 1 and 2 apart. Within the opposite hollow handles 4 and 5 is a toggle lever 11 extending at an angle therebetween. The opposite ends of the toggle are positioned within the channels of the two handles 4, 5. The upper end of the toggle is transversely pivoted on a pivot 12 and its bottom end is provided with a spherical recess 16 into which snugly fits the rounded end 17 of a screw 13 terminated on the opposite end by a head 13′.

The toggle lever 11 is provided intermediate its ends with a laterally-extending shoulder 19. This shoulder is directed into the channel of handle 5 and rests against the upper end 19′ of a release lever 20 whose bottom end 19'' extends outwardly of handle 5. Release lever 20 has a projection 22 which is pivoted on a pin 21 transversely extending throughthe side walls of handle 5.

The gripping action exerted by the jaws 1 and 2 may be instantly released by pulling on the outer end 19'' of the release lever 20 toward the inner wall of handle 5. Screw 13 may be longitudinally moved by turning its head 13' clockwise or counterclockwise, thereby adjusting the jaws 1 and 2 for different size nuts intended to be gripped.

FIGS. 3–5 illustrate the gripping action of wrench 10 on different size nuts 30: FIG. 3 shows the smallest nut; FIG. 4 shows a medium size nut; and FIG. 5 shows the largest nut for which the wrench is designed. For all nut sizes within a specified range, the gripping wall portions 43, 44 of rotatable jaw 2 will always grip two adjacent sides of the nut. The rotation of jaw 2 about a transverse axis makes that possible. When handle 5 is depressed, the resultant force produced by jaw 2 is directed toward the center of angle *a* (FIG. 1) thereby forcefully maintaining nut 30 against walls 40, 42 of stationary jaw 1. FIGS. 3–5 show wrench 10 resisting a clockwise torque applied in the direction of arrow 79.

Figure 6:
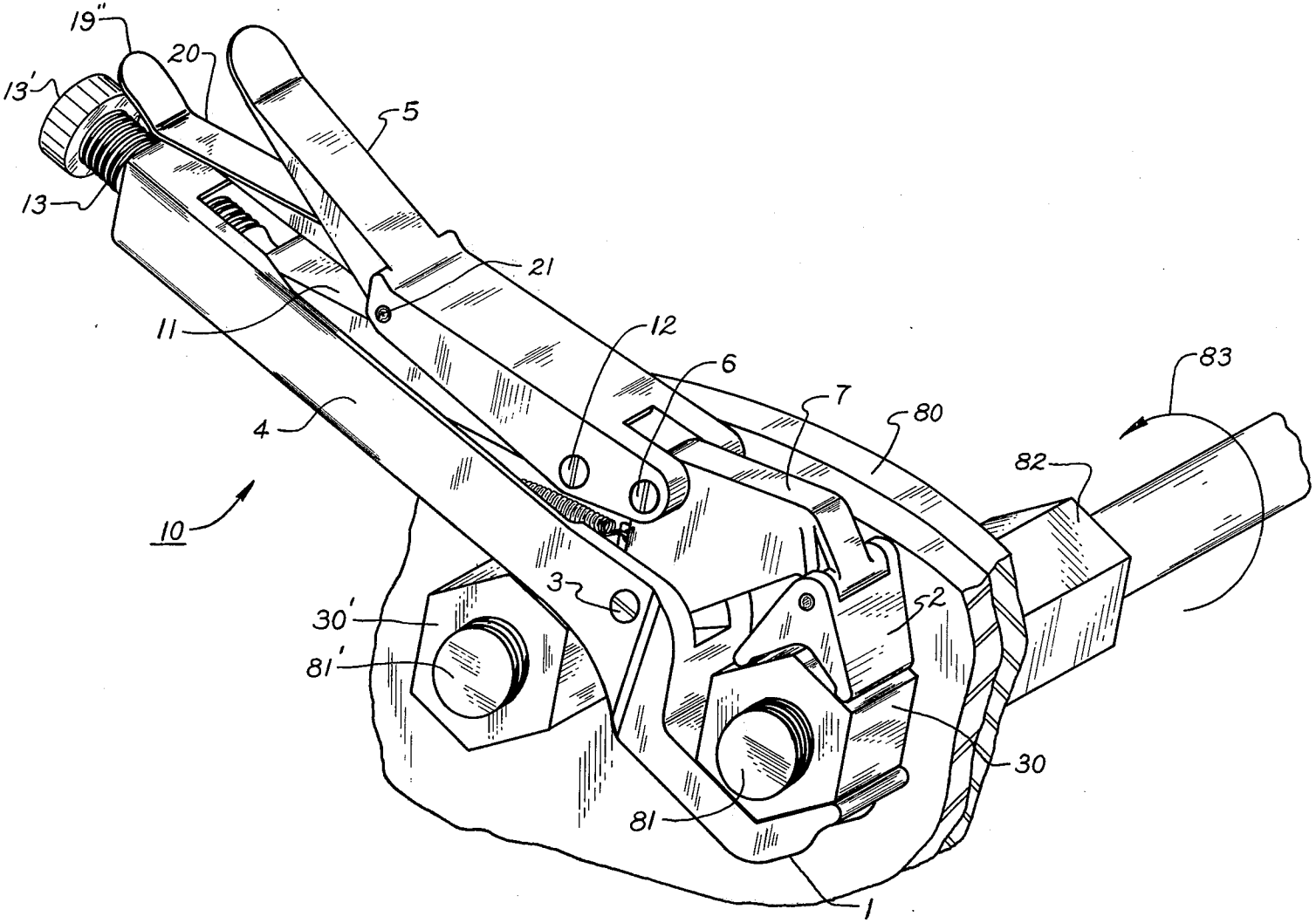
FIG. 6 illustrates the use of the back-up wrench of this invention on a flanged connection.

The preferred use of the back-up wrench 10 of this invention is illustrated in FIG. 6 wherein there is shown a portion of a flanged connection 80 held together by a plurality of bolts 81 arranged in any desired pattern. The bolt heads on the right-hand side of the flanged connection 80 are rotated by any suitable tool 82, typically a power-driven wrench, rotated in a clockwise direction, as shown by the arrow 83. Jaws 1 and 2 of the back-up tool 10 are positioned on the opposite nut 30. The handles 4 and 5 are pulled together so that stationary handle 4 rests firmly on and is wedged against the next adjacent nut 30' on bolt 81', which provides the required reaction to the torque exerted by power tool 82.

After the nut-tightening operation and in accordance with a very important aspect of this invention, wrench 10 can be released very easily by only lifting the release lever 20. Prior art back-up wrenches, when placed under a similar load, had to be released by a striking blow from a heavy hammer or pried loose by a long pry bar.

While this invention has been described with reference to hexagonal nuts, it obviously is not limited thereto. Also, modifications may be made in the geometric configurations of the jaws without departing from the invention as defined in the claims attached hereto.

What I claim is:

1. A plier-type wrench for gripping an hexagonally-shaped member, comprising:

a first handle, a first jaw forming integral part with said handle and consisting of a first wall, extending generally in the direction of said handle, and of a second wall extending inwardly and at an angle of approximately 120° from said first wall, said first jaw being adapted to grip one angle of said member;

a plate having a bottom end pivotally mounted on said first handle below said first wall and a top end forming a first external cylindrical bearing surface;

a second jaw having a second external cylindrical bearing surface rotatably mounted on said first bearing surface, said second jaw consisting solely of two spaced-apart lobes at the opposite ends thereof and having a large concavity therebetween such that only said lobes can grip a second angle of said member which is directly opposite to said first angle;

a second handle pivotally mounted on a rearward extension of said plate;

spring means coupled between said plate and said first handle tending to move said jaws apart; and manually-operated means in and between said handles for pivoting said plate toward said first handle, thereby causing said second jaw to forcibly push said member against said first jaw.

2. The back-up wrench of claim 1 wherein said last means include a release lever pivotally mounted on said rotatable handle.

3. The wrench of claim 2 wherein said last means further include:

a longitudinal screw mounted in the end of said first handle, a toggle lever having an upper end pivotally mounted on said second handle and a rear end rotatable on said longitudinal screw.

* * * * *